US006254743B1

(12) United States Patent
Bennett et al.

(10) Patent No.: US 6,254,743 B1
(45) **Date of Patent: *Jul. 3, 2001**

(54) EXPANDED TITANIUM METAL MESH

(75) Inventors: John E. Bennett, Painesville; Gerald R. Pohto; Thomas A. Mitchell, both of Mentor, all of OH (US)

(73) Assignee: Eltech Systems Corporation, Fairport, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 07/632,907

(22) Filed: Dec. 24, 1990

Related U.S. Application Data

(63) Continuation of application No. 06/855,552, filed on Apr. 29, 1986, now abandoned, which is a continuation-in-part of application No. 06/731,420, filed on May 7, 1985, now abandoned.

(51) Int. Cl.[7] ..... C23F 13/10; C25B 11/03; C25B 11/10

(52) U.S. Cl. ..... 204/284; 204/196.01; 204/196.36; 204/196.38; 204/290.13; 204/290.14; 205/724; 205/734; 205/738

(58) Field of Search ..... 204/147, 148, 204/196, 197, 290 F, 284

(56) References Cited

U.S. PATENT DOCUMENTS

| | | | |
|---|---|---|---|
| 1,140,117 | * | 5/1915 | Clark . |
| 2,916,429 | | 12/1959 | Vossnack et al. . |
| 2,933,410 | * | 4/1960 | Brightly . |
| 3,265,526 | | 8/1966 | Beer . |

(List continued on next page.)

FOREIGN PATENT DOCUMENTS

| | | | |
|---|---|---|---|
| 1235088 | * | 4/1988 | (CA) . |
| 0147977 | | 7/1985 | (EP) . |
| 240561 | | 10/1925 | (GB) . |
| 634217 | * | 3/1950 | (GB) . |
| 885817 | * | 12/1961 | (GB) . |
| 896912 | | 5/1962 | (GB) . |
| 1285417 | * | 8/1972 | (GB) . |
| 1562720 | * | 3/1980 | (GB) . |
| 1603843 | * | 12/1981 | (GB) . |
| 2140456 | | 11/1984 | (GB) . |
| 2175609A | * | 12/1986 | (GB) . |
| 57-145992 | | 9/1982 | (JP) . |

OTHER PUBLICATIONS

International Search Report, International Application No. PCT/US 86/00932; Patent Abstracts of Japan, vol. 7, No. 191(c–182) (1336), Aug. 20, 1983 and JP, A, 5891178 (Osaka Soda K.K.) May 31, 1983.

Raychem Ferex[tm] 100 Information Sheet, Feb. 1984.

Engineering News–Record, Jun. 14, 1984, The McGraw–Hill Construction Weekly.

Reprint Engineering News–Record, Jul. 11, 1985, The McGraw–Hill Weeky.

Niles Expanded Metals Catalog, p. 12, (1973), month unavailable.

"Platinized Anode in Carbonaceous Backfill—An Evaluation," T. H. Lewis, Jr., P.E., Paper No. 194, Corrosion/79, month unavailable.

*Primary Examiner*—T. Tung
(74) *Attorney, Agent, or Firm*—Hudak & Shunk Co., L.P.A.; Michele M. Tyrpak

(57) ABSTRACT

This invention relates generally to an electrically conductive valve metal mesh of extreme void fraction. More particularly the invention relates in a most important aspect to an application thereof for an electrode structure in such a way as to prevent the corrosion of steel, including reinforcing steel in concrete, by cathodic protection.

13 Claims, 1 Drawing Sheet

U.S. PATENT DOCUMENTS

| | | |
|---|---|---|
| 3,278,404 | 10/1966 | Cotton et al. . |
| 3,632,498 | 1/1972 | Beer . |
| 3,671,415 | 6/1972 | King et al. . |
| 3,711,385 | 1/1973 | Beer . |
| 3,981,790 | 9/1976 | Olson et al. . |
| 4,097,346 | 6/1978 | Robertson . |
| 4,097,347 | 6/1978 | Packer . |
| 4,187,164 | 2/1980 | Warne . |
| 4,255,241 | 3/1981 | Kroon et al. . |
| 4,292,149 | 9/1981 | Warne . |
| 4,415,411 | 11/1983 | Kanai et al. . |
| 4,460,441 | 7/1984 | Domning . |
| 4,502,929 | 3/1985 | Stewart et al. . |
| 4,519,886 | 5/1985 | de Nora et al. . |
| 4,519,888 | 5/1985 | Akazawa et al. . |
| 4,528,084 | 7/1985 | Beer et al. . |

* cited by examiner

EXPANDED TITANIUM METAL MESH

CROSS REFERENCE TO RELATED APPLICATION

This is a continuation of application Ser. No. 06/855,552, filed Apr. 29, 1986, abandoned, which in turn is a continuation-in-part of application Ser. No. 06/731,420, filed May 7, 1985, abandoned.

BACKGROUND OF THE INVENTION

The most important development in electrolysis electrodes in recent years has been the advent of dimensionally stable electrodes following the teachings of U.S. Pat. Nos. 3,771,385 and 3,632,498. These dimensionally stable electrodes consist of a base or substrate of a valve metal, typically titanium, carrying an electrocatalytic coating such as a mixed oxide of platinum group metal and a valve metal forming a mixed crystal or solid solution. Many different coating formulations have been proposed.

The major use of these dimensionally stable electrodes has been as anodes in chlor-alkali production in mercury cells, diaphragm cells and more recently in membrane cells. Other uses have been as oxygen-evolving anodes for metal electrowinning processes, for hypochlorite and chlorate production, as metal plating anodes and so on. Use as an anode in cathodic protection has also been proposed and as cathodes in certain processes.

Depending on the use, these dimensionally stable valve metal electrodes have been proposed with various configurations such as rods, tubes, plates and complex structures such as an array of rods or blades mounted on a supporting current conducting assembly as well as a mesh of expanded valve metal typically having diamond shaped voids mounted on a supporting current conducting assembly which provides the necessary rigidity.

Electrodes in the form of platinized valve metal wire are known for cathodic protection, but in practically every other application rigidity and dimensional stability of the electrode are critical factors for successful operation. For example, many electrolytic cells are operated with an inter-electrode gap of only a few millimeters and the flatness and rigidity of the operative electrode face are extremely important.

For most applications, the dimensionally stable electrodes operate at relatively high current densities, typically 3–5 $KA/m^2$ for membrane cells, 1–3 $KA/m^2$ for diaphragm ceris and 6–10 $KA/m^2$ for mercury cells. These high current densities, combined with the requirements of planarity/rigidity, necessitate valve metal structures of substantial current carrying capacity and strength.

Typical known valve metal electrodes of the type with expanded titanium mesh as operative face use a mesh having an expansion factor of 1.5 to 4 times providing a void fraction of about 30 to 70 percent. Such titanium sheets may be slightly flexible during the manufacturing processes but the inherent elasticity of the sheet is restrained, e.g. by welding it to a current conductive structure, typically having one or more braces extending parallel to the SWD dimension of the diamond-shaped openings. Such electrode sheets typically have a current-carrying capacity of 2–10 $KA/m^2$ of the electrode surface.

Other electrode configurations are known for special purposes, e.g., a rigid cylindrical valve metal sheet mounted in a linear type of anode structure for cathodic protection (see U.S. Pat. No. 4,515,886).

Manufacture of the known electrodes usually involves assembly of the electrode valve metal structure, e.g. by welding, followed by surface treatment such as degreasing/etching/sandblasting and application of the electrocatalytic coating by various methods including chemi-deposition, electroplating and plasma spraying. Chemi-deposition may involve the application of a coating solution to the electrode structure by dipping or spraying, followed by baking usually in an oxidizing atmosphere such as air.

SUMMARY OF THE INVENTION

It has now been found that titanium and other valve metals, e.g., tantalum and zirconium, can be greatly-expanded to a pattern of substantially diamond-shaped voids having an extremely high void fraction. Having been expanded in this way material cost becomes acceptable and they form an ideal structure for cathodic protection, e.g., of reinforcing steel in concrete as has been more particularly discussed in the U.S. Pat. NO. 4,900,410. Moreover the greatly expanded mesh is flexible and coilable and uncoilable about an axis along the LWD dimension. Thus the expanded metal can be supplied in the form of large rolls which can be easily unrolled onto a surface to be protected, such as a concrete deck or a concrete substructure. The pattern of voids in the mesh is defined by a continuum of valve metal strands interconnected at nodes and carrying on their surface an electrocatalytic coating. These multiplicity of strands provide redundancy for current flow in the event that one or more strands become broken during shipping or installation. The metal mesh is desirably stretchable along the SWD dimension of the pattern units whereby a coiled electrode roll of the mesh can be uncoiled on, and stretched over, a supporting substrate and into an operative electrode configuration, as more particularly described in the U.S. Pat. No. 4,900,410. This application and the other application mentioned above are herein incorporated by reference.

The electrode system of the present invention satisfies all of the requirements for cathodic protection of reinforcing steel in concrete. It consists of the highly expanded valve metal which is activated by an electrocatalytic coating. Current can be distributed to the expanded valve metal by a welded contact of the same valve metal. A multitude of current paths in the expanded metal structure provide for redundancy of current distribution and hence the distribution of current to the reinforcing steel is excellent. Installation is simple since an electrode of greater than 100 square meters can be quickly rolled onto the surface of a concrete deck or-easily wrapped around a concrete substructure.

The electrocatalytic coating used in the present invention is such that the anode operates at a very low single electrode potential, and may have a life expectancy of greater than 20 years in a cathodic protection application. Unlike other anodes used heretofore for the cathodic protection of steel in concrete, it is completely stable dimensionally and produces no carbon dioxide or chlorine from chloride contaminated concrete. It furthermore has sufficient surface area such that the acid generated from the anodic reaction will not be detrimental to the surrounding concrete. The preferred coating operation for applying the electrocatalytic coating has been more particularly described in the U.S. Pat. No. 4,708,888.

In its broadest aspect, the present invention is directed to an electrode for electrochemical processes comprising a valve metal mesh having a pattern of substantially diamond-shaped voids having LWD and SWD dimensions for units of the pattern, the pattern of voids being defined by a continuum of valve metal strands interconnected at nodes and carrying on their surface an electrochemically active coating, wherein the mesh of valve metal is a flexible mesh with strands of thickness less than 0.125 cm and having a void fraction of at least 80%, said flexible mesh being coilable and uncoilable about an axis along the LWD dimension of the pattern units and being stretchable by up to about 10% along the SWD dimension of the pattern units and further being bendable in the general plane of the mesh about a bending radius in the range of from 5 to 25 times the width of the mesh, whereby said electrode can be uncoiled from a coiled configuration onto a supporting surface on which the mesh can be stretched to an operative electrode configuration.

In other important aspects the invention is directed to greatly expanded valve metal mesh as well as to a method for preparing such greatly expanded mesh.

DESCRIPTION OF THE PREFERRED EMBODIMENTS

Figure 1:
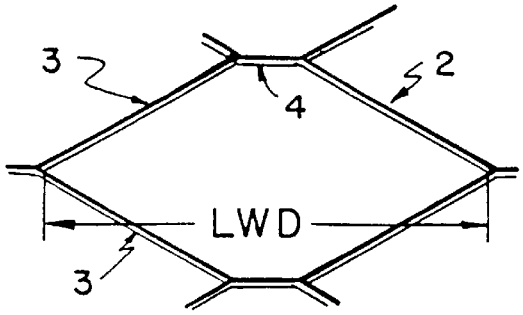
FIG. 1 shows a diamond-shaped unit of a greatly expanded valve metal mesh of the present invention.

The metals of the valve metal mesh will most always be any of titanium, tantalum, zirconium and niobium. As well as the elemental metals themselves, the suitable metals of the mesh can include alloys of these metals with themselves and other metals as well as their intermetallic mixtures. Of particular interest for its ruggedness, corrosion resistance and availability is titanium. Where the mesh will be expanded from a metal sheet, the useful metal of the sheet will most always be an annealed metal. As representative of such serviceable annealed metals is Grade I titanium, an annealed titanium of low embrittlement. Such feature of low embrittlement is necessary where the mesh is to be prepared by expansion of a metal sheet, since such sheet should have an elongation of greater than 20 percent. This would be an elongation as determined at normal temperature, e.g., 20° C., and is the percentage elongation as determined in a two-inch (5 cm.) sheet of greater than 0.025 inch (0.0635 cm.) thickness. Metals for expansion having an elongation of less than 20 percent will be too brittle to insure suitable expansion to useful mesh without deleterious strand breakage.

Advantageously for enhanced freedom from strand breakage, the metal used in expansion will have an elongation of at least: about 24 percent and will virtually always have an elongation of not greater than about 40 percent. Thus metals such as aluminum are neither contemplated, nor are they useful, for the mesh in the present invention, aluminum being particularly unsuitable because of its lack of corrosion resistance. Also with regard to the useful metals, annealing may be critical as for example with the metal tantalum where an annealed sheet can be expected to have an elongation on the order of 37 to 40 percent, which metal in unannealed form may be completely useless for preparing the metal mesh by having an elongation on the order of only 3 to 5 percent. Moreover, alloying may add to the embrittlement of an elemental metal and thus suitable alloys may have to be carefully selected. For example, a titanium-palladium alloy, commercially available as Grade 7 alloy and containing on the order of 0.2 weight percent palladium, will have an elongation at normal temperature of above about 20 percent and is expensive but could be serviceable, particularly in annealed form. Moreover, where alloys are contemplated, the expected corrosion resistance of a particular alloy that might be selected may also be a consideration. For example, in Grade I titanium, such is usually available containing 0.2 weight percent iron. However, for superior corrosion resistance, Grade I titanium is also available containing less than about 0.05 weight percent iron. Generally, this metal of lower iron content will be preferable for many applications owing to its enhanced corrosion resistance.

The metal mesh may then be prepared directly from the selected metal. For best ruggedness in extended metal mesh life, it is preferred that the mesh be expanded from a sheet or coil of the valve metal. It is however contemplated that alternative meshes to expanded metal meshes may be serviceable. For such alternatives, thin metal ribbons can be corrugated and individual cells, such as honeycomb shaped cells can be resistance welded together from the ribbons. Slitters or corrugating apparatus could be useful in preparing the metal ribbons and automatic resistance welding could be utilized to prepare the large void fraction mesh. By the preferred expansion technique, a mesh of interconnected metal strands can directly result. Typically where care has been chosen in selecting a metal of appropriate elongation, a highly serviceable mesh will be prepared using such expansion technique with no broken strands being present. Moreover with the highly serviceable annealed valve metals having desirable ruggedness coupled with the requisite elongation characteristic, some stretching of the expanded mesh can be accommodated during installation of the mesh. This can be of particular assistance where uneven substrate surface or shape will be most readily protected by applying a mesh with such stretching ability. Generally a stretching ability of up to about 10 percent can be accommodated from a roll of Grade I titanium mesh having characteristics such as discussed hereinbelow in the example. Moreover the mesh obtained can be expected to be bendable in the general plane of the mesh about a bending radius in the range of from 5 to 25 times the width of the mesh.

Where the mesh is expanded from the metal sheet, the interconnected metal strands will have a thickness dimension corresponding to the thickness of the initial planar sheet or coil. Usually this thickness will be within the range of from about 0.05 centimeter to about 0.125 centimeter. Use of a sheet having a thickness of less than about 0.05 centimeter, in an expansion operation, can not only lead to a deleterious number of broken strands, but also can produce a too flexible material that is difficult to handle. For economy, sheets of greater than about 0.125 centimeter are avoided. As a result of the expansion operation, the strands will interconnect at nodes providing a double strand thickness of the nodes. Thus the node thickness will be within the range of from about 0.1 centimeter to about 0.25 centimeter. Moreover, after expansion the nodes for the special mesh will be completely, to virtually completely, non-angulated. By that it is meant that the plane of the nodes through their thickness will be completely, to virtually completely, vertical in reference to the horizontal plane of an uncoiled roll of the mesh.

In considering the preferred valve metal titanium, the weight of the mesh will usually be within the range of from about 0.05 kilogram per square meter to about 0.5 kilogram per square meter of the mesh. Although this range is based upon the exemplary metal titanium, such can nevertheless serve as a useful range for the valve metals generally. Titanium is the valve metal of lowest specific gravity. On this basis, the range can be calculated for a differing valve metal based upon its specific gravity relationship with titanium. Referring again to titanium, a weight of less than about 0.05 kilogram per square meter of mesh will be insufficient for proper current distribution in enhanced cathodic protection. On the other hand, a weight of greater than about 0.5 kilogram per square meter will most always be uneconomical for the intended service of the mesh.

The mesh can then be produced by expanding a sheet or coil of metal of appropriate thickness by an expansion factor of at least 10 times, and preferably at least 15 times. Useful mesh can also be prepared where a metal sheet has been expanded by a factor up to 30 times its original area. Even for an annealed valve metal of elongation greater than 20 percent, an expansion factor of greater than 30:1 may lead to the preparation of a mesh exhibiting strand breakage. On the other hand, an expansion factor of less than about 10:1 may leave additional metal without augmenting cathodic protection. Further in this regard, the resulting expanded mesh should have an at least 80 percent void fraction for efficiency and economy of cathodic protection. Most preferably, the expanded metal mesh will have a void fraction of at least about 90 percent, and may be as great as 92 to 96 percent or more, while still supplying sufficient metal and economical current distribution. With such void fraction, the metal strands can be connected at a multiplicity of nodes providing a redundancy of current-carrying paths through the mesh which insures effective current distribution throughout the mesh even in the event of possible breakage of a number of individual strands, e.g., any breakage which might occur during installation or use. Within the expansion factor range as discussed hereinbefore, such suitable redundancy for the metal strands will be provided in a network of strands most always interconnected by from about 500 to about 2000 nodes per square meter of the mesh. Greater than about 2000 nodes per square meter of the mesh is uneconomical. On the other hand, less than about 500 of the interconnecting nodes per square meter of the mesh may provide for insufficient redundancy in the mesh.

Within the above-discussed weight range for the mesh, and referring to a sheet thickness of between about 0.05–0.125 centimeter, it can be expected that strands within such thickness range will have width dimensions of from about 0.05 centimeter to about 0.20 centimeter. For the special application to cathodic protection in concrete, it is expected that the total surface area of interconnected metal, i.e., including the total surface area of strands plus nodes, will provide between about 10 percent up to about 50 percent of the area covered by the metal mesh. Since this surface area is the total area, as for example contributed by all four faces of a strand of square cross-section, it will be appreciated that even at a 90 percent void fraction such mesh can have a much greater than 10 percent mesh surface area. This area will usually be referred to herein as the "surface area of the metal" or the "metal surface area". If the total surface area of the metal is less than about 10 percent, the resulting mesh can be sufficiently fragile to lead to deleterious strand breakage. On the other hand, greater than about 50 percent surface area of metal will supply additional metal without a commensurate enhancement in protection.

After expansion the resulting mesh can be readily rolled into coiled configuration, such as for storage or transport or further operation. With the representative valve metal titanium, rolls having a hollow inner diameter of greater than 20 centimeters and an outer diameter of up to 150 centimeters, preferably 100 centimeters, can be prepared. These rolls can be suitably coiled from the mesh when such is prepared in lengths within the range of from about 40 to about 200, and preferably up to 100, meters. For the metal titanium, such rolls will have weight on the order of about 10–50 kilograms, but usually below 30 kilograms to be serviceable for handling, especially following coating, and particularly handling in the field during installation for cathodic protection.

The coated metal mesh can serve for cathodic protection of steel reinforced concrete. It may also be similarly serviceable in direct earth burial cathodic protection. Generally, it may be utilized in any operation wherein the electrocatalytic coating on a valve metal substrate will be useful and wherein current density operating conditions up to 10 amps per square meter of mesh area are contemplated. It is advantageous if the coated metal mesh is in coiled form, as for rolling out of an electrode to be incorporated in a cathodic protection system as discussed in the U.S. application Ser. No. 07/590,623, filed Sep. 28, 1990, now U.S. Pat. No. 5,421,968, which system is preferably installed as discussed in the U.S. Pat. No. 4,900,410. The teachings of these foregoing applications is herein incorporated by reference.

In such greatly expanded valve metal mesh it is most typical that the gap patterns in the mesh will be formed as diamond-shaped apertures. Such "diamond-pattern" will feature apertures having a long way of design (LWD) from about 4, and preferably from about 6, centimeters up to about 9 centimeters, although a longer LWD is contemplated, and a short way of design (SWD) of from about 2, and preferably from about 2.5, up to about 4 centimeters. In the preferred application of cathodic protection in concrete, diamond dimensions having an LWD exceeding about 9 centimeters may lead to undue strand breakage and undesirable voltage loss. An SWD of less than about 2 centimeters, or an LWD of less than about 4 centimeters, in the preferred application, can be uneconomical in supplying an unneeded amount of metal for desirable cathodic protection.

Referring now more particularly to FIG. 1 an individual diamond shape, from a sheet containing many such shapes is shown generally at 2. The shape is formed from strands 3 joining at connections (nodes) 4. As shown in the Figure, the strands 3 and connections 4 form a diamond aperture having a long way of design in a horizontal direction. The short way of design is in the opposite, vertical direction. When referring to the surface area of the interconnected metal strands 3, e.g., where such surface area will supply not less than about 10 percent of the overall measured area of the expanded metal as discussed hereinabove, such surface area is the total area around a strand 3 and the connections 4. For example, in a strand 3 of square cross-section, the surface area of the strand 3 will be four times the depicted, one-side-only, area as seen in the Figure. Thus in FIG. 1, although the strands 3 and their connections 4 appear thin, they may readily contribute 20 to 30 percent surface area to the overall measured area of the expanded metal. In the FIG. 1, the "area of the mesh", e.g., the square meters of the mesh, as such terms are used herein, is the area encompassed within an imaginary line drawn around the periphery of the Figure.

In FIG. 1, the area within the diamond, i.e., within the strands 3 and connections 4, may be referred to herein as the "diamond aperture". It is the area having the LWD and SWD dimensions. For convenience, it may also be referred to herein as the "void", or referred to herein as the "void fraction", when based upon such area plus the area of the metal around the void. As noted in FIG. 1 and as discussed hereinbefore, the metal mesh as used herein has extremely great void fraction. Although the shape depicted in the figure is diamond-shaped, it is to be understood that many other shapes can be serviceable to achieve the extremely great void fraction, e.g., scallop-shaped or hexagonal.

Figure 2:
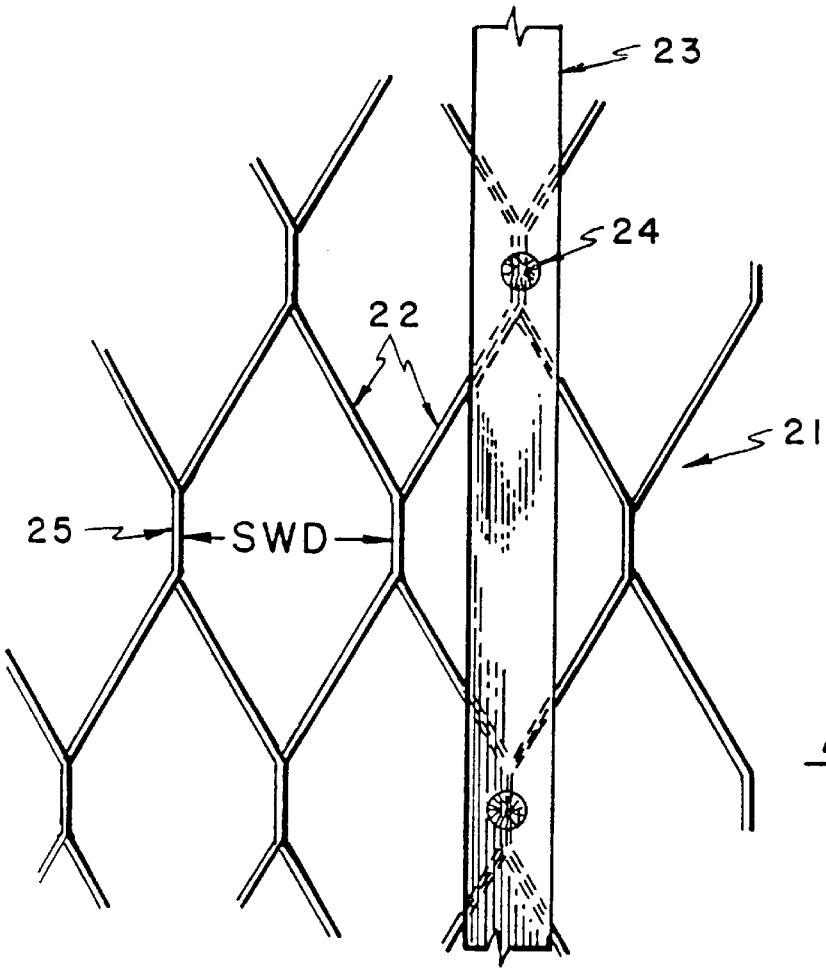
FIG. 2 shows a section of greatly expanded valve metal mesh, embodying diamond-shaped structure, and having a current distributor along the LWD dimension and welded to mesh nodes.

Referring now to FIG. 2, several individual diamonds 21 are formed of individual strands 22 and their interconnections 25 thereby providing diamond-shaped apertures. A row of the diamonds 21 is bonded to a metal strip 23 at the intersections 25 of strands 22 with the metal strip 23 running along the LWD of the diamond pattern. The assembly is brought together by spotwelds 24, with each individual strand connection (node) 25 located under the strip 23 being welded by a spotweld 24. Generally the welding employed will be electrical resistance welding and this will most always simply be spot welding, for economy, although other, similar welding technique, e.g., roller welding, is contemplated. This provides a firm interconnection for good electroconductivity between the strip 23 and the strands 22. As can be appreciated by reference particularly to FIG. 2, the strands 22 and connections 25 can form a substantially planar configuration. As such term is used herein it is meant that particularly larger dimensional sheets of the mesh may be generally in coiled or rolled condition, as for storage or handling, but are capable of being unrolled into a "substantially planar" condition or configuration, i.e., substantially flat form, for use. Moreover, the connections 25 will have double strand thickness, whereby even when rolled flat, the substantially planar or flat configuration may nevertheless have ridged connections.

Figure 3:
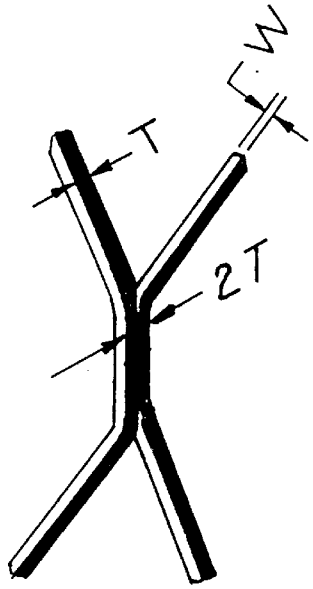
FIG. 3 is an enlarged view of a mesh node, particularly showing the node double strand thickness.

Referring then to the enlarged view in FIG. 3, it can be seen that the nodes have double strand thickness (2T). Thus, the individual strands have a lateral depth or thickness (T) not to exceed about 0.125 centimeter, as discussed hereinabove, and a facing width (W) which may be up to about 0.20 centimeter.

The expanded metal mesh can be usefully coated. It is to be understood that the mesh may also be coated before it is in mesh form, or combinations might be useful. Whether coated before or after being in mesh form, the substrate can be particularly useful for bearing a catalytic active material, thereby forming a catalytic structure. As an aspect of this use, the mesh substrate can have a catalyst coating, resulting in an anode structure. Usually before any of this, the valve metal mesh will be subjected to a cleaning operation, e.g., a degreasing operation, which can include cleaning plus etching, as is well known in the art of preparing a valve metal to receive an electrochemically active coating. It is also well known that a valve metal, which may also be referred to herein as a "film-forming" metal, will not function as an anode without an electrochemically active coating which prevents passivation of the valve metal surface. This electrochemically active coating may be provided from platinum or other platinum group metal, or it may be any of a number of active oxide coatings such as the platinum group metal oxides, magnetite, ferrite, cobalt spinel, or mixed metal oxide coatings, which have been developed for use as anode coatings in the industrial electrochemical industry. It is particularly preferred for extended life protection of concrete structures that the anode coating be a mixed metal oxide, which can be a solid solution of a film-forming metal oxide and a platinum group metal oxide.

For this extended protection application, the coating is typically present in an amount of from about 0.05 to about 0.5 gram of platinum group metal per square meter of expanded valve metal mesh. Less than about 0.05 gram of platinum group metal will provide insufficient electrochemically active coating to serve for preventing passivation of the valve metal substrate over extended time, or to economically function at a sufficiently low single electrode potential to promote selectivity of the anodic reaction. On the other hand, the presence of greater than about 0.5 gram of platinum group metal per square meter of the expanded valve metal mesh can contribute an expense without commensurate improvement in anode lifetime. In this particular embodiment of the invention, the mixed metal oxide coating is highly catalytic for the oxygen evolution reaction, and in a chloride contaminated concrete environment, will evolve no chlorine or hypochlorite. The platinum group metal or mixed metal oxides for the coating are such as have been generally been described in one or more of U.S. Pat. Nos. 3,265,526, 3,632,498, 3,711,385 and 4,528,084. More particularly, such platinum group metals include platinum, palladium, rhodium, iridium and ruthenium or alloys of themselves and with other metals. Mixed metal oxides include at least one of the oxides of these platinum group metals in combination with at least one oxide of a valve metal or another non-precious metal. It is preferred for economy that the coating be such as have been disclosed in the U.S. Pat. No. 4,528,084.

In such concrete corrosion retarding application, the metal mesh will be connected to a current distribution member, e.g., the metal strip 23 of FIG. 2. Such member will most always be a valve metal and preferably is the same metal alloy or intermetallic mixture as the metal most predominantly found in the expanded valve metal mesh. This current distribution member must be firmly affixed to the metal mesh. Such a manner of firmly fixing the member to the mesh can be by welding as has been discussed hereinabove. Moreover, the welding can proceed through the coating. Thus, a coated strip can be laid on a coated mesh, with coated faces in contact, and yet the welding can readily proceed. The strip can be welded to the mesh at every node and thereby provide uniform distribution of current thereto. Such a member positioned along a piece of mesh about every 30 meters will usually be sufficient to serve as a current distributor for such piece.

In the application of the cathodic protection for concrete, it is important that the embedded portion of the current distribution member be also coated, such as with the same electrochemically active coating of the mesh. Like considerations for the coating weight, such as for the mesh, are also important for the current distributor member. The member may be attached to the mesh before or after the member is coated. Such current distributor member can then connect. outside of the concrete environment to a current conductor, which current conductor being external to the concrete need not be so coated. For example in the case of a concrete bridge deck, the current distribution member may be a bar extending through a hole to the underside of the deck surface where a current conductor is located. In this way all mechanical current connections are made external to the finished concrete structure, and are thereby readily available for access and service if necessary. Connections to the current distribution bar external to the concrete may be of conventional mechanical means such as a bolted spade-lug connector.

Application of the coated mesh for corrosion protection such as to a concrete deck or substructure can be simplistic. A roll of the greatly expanded valve metal mesh with a suitable electrochemically active coating, sometimes referred to hereinafter simply as the "anode", can be unrolled onto the surface of such deck or substructure. Thereafter, means of fixing mesh to substructure can be any of those useful for binding a metal mesh to concrete that will not deleteriously disrupt the anodic nature of the mesh. Usually, non-conductive retaining members will be useful. Such retaining members for economy are advantageously plastic and in a form such as pegs or studs. For example, plastics such as polyvinyl halides or polyolefins can be useful. These plastic retaining members can be inserted into holes drilled into the concrete. Such retainers may have an enlarged head engaging a strand of the mesh under the head to hold the anode in place, or the retainers may be partially slotted to grip a strand of the mesh located directly over the hole drilled into the concrete.

Usually when the anode is in place and while held in close contact with the concrete substructure by means of the retainers, an ionically conductive overlay will be employed to completely cover the anode structure. Such overlay may further enhance firm contact between the anode and the concrete substructure. Serviceable ionically conductive overlays include portland cement and polymer-modified concrete.

In typical operation, the anode can be overlaid with from about 2 to about 6 centimeters of a portland cement or a latex modified concrete. In the case where a thin overlay is particularly desirable, the anode may be generally covered by from about 0.5 to about 2 centimeters of polymer modified concrete. The expanded valve metal mesh substrate of the anode provides the additional advantage of acting as a metal reinforcing means, thereby improving the mechanical properties a nd useful life of the overlay. It is contemplated that the metal mesh anode structure will be used with any such materials and in any such techniques as are well known in the art of repairing underlying concrete structures such as bridge decks and support columns and the like.

The following example shows a way in which the invention has been practiced, but should not be construed as limiting the invention.

EXAMPLE

An imperforate sheet of Grade I titanium 100 centimeter (cm) wide×300 cm long×0.889 millimeter (mm) thick (T), and having an elongation at 68° C. of 24 percent for a 2-inch (5 cm.) sheet greater than 0.025 inch (0.0635 cm.) thick, was expanded to a diamond pattern. The dies doing the piercing of the sheet also acted as forming dies to expand the punched slits into the diamond-shaped openings. The process employed a punch with a full indexing to one side to complete the design. Each diamond measured 7.62 cm LWD×3.38 cm SWD. Expansion factor was 19 to 1, e.g. a test sheet 160 cm. long was expanded during the patterning to approximately 30.5 m, providing a void fraction of 95 percent. The final strand dimension was 0.889 mm (T)× 0.914 mm (W) Expansion was at a rate of 220 strokes per minute with no broken strands. The finished expanded titanium had a weight of 0.20 kilogram (Kg) per square meter ($m^2$) of the resulting mesh and an actual metal surface area (strands plus nodes) of 0.23 $m^2$ per square meter of the resulting mesh. The 30.5 m long mesh was conveniently stored and handled in rolled configuration.

A current distribution bar was spot welded to one end of a piece of the expanded titanium, taken from the unrolled mesh, which measured 30 cm×38 cm. The structure was next vapor degreased in perchlorethylene vapor and etched in a 20 weight percent HCl solution for 5 minutes. It was thereafter water rinsed and steam dried. It was then coated with mixed oxides of titanium and ruthenium in which the ruthenium content was 0.35 gram per square meter. Anodes prepared in this manner were subjected to accelerated life testing at high current density in 1.0 M $H_2SO_4$. An anode at 300,000 ($3\times10^5$ milliamps (mA) per square meter failed after 7.5 hours, and an anode at 100,000 ($1\times10^5$) mA per square meter failed after 82 hours under these conditions. Using known relationships between current density and anode lifetime, these results extrapolate to an expected life of over 200 years at a practical current density of 100 mA per square meter of the metal surface area of the expanded titanium.

An anode prepared as described above is then placed on top of a chloride contaminated concrete block and overlaid with 50 mm thickness of portland cement. A second identical anode is also placed on top of a chloride contaminated concrete block and overlaid with a 38 mm thickness of latex modified concrete. Both structures are judged by visual inspection to have desirable interbonding of the cement to concrete for the one block and of the modified concrete to concrete for the second block. From the hereinabove described accelerated life tests, lifetimes of anodes in these blocks are therefore expected to be very long.

What is claimed is:

1. A greatly expanded titanium metal mesh of enhanced void fraction, said greatly expanded mesh being selected from the group consisting of titanium metal, titanium metal alloys, and intermetallic mixtures containing titanium metal, said titanium mesh having a pattern of substantially diamond-shaped voids having LWD and SWD dimensions for units of the pattern, the pattern of voids being defined by a continuum of metal strands interconnected at nodes, wherein the mesh is a flexible and stretchable titanium mesh with strands of thickness less than 0.125 cm and having a void fraction of at least 90%, said flexible and stretchable mesh being coilable and uncoilable about an axis along the LWD dimension of the pattern units and being stretchable along the SWD dimension of the pattern units and further being bendable in the general plane of the mesh about a bending radius in the range from 5 to 25 times the width of the mesh, with the mesh nodes being of double strand thickness.

2. The titanium metal mesh of claim 1 wherein said titanium metal has an elongation within the range of from 20 percent to about 40 percent.

3. The titanium metal mesh of claim 1, wherein said titanium metal is an annealed, unalloyed metal.

4. The titanium metal mesh of claim 1, wherein the mesh weight of said metal is within the range of from about 0.05 to about 0.5 kilogram of metal per square meter of said mesh.

5. The titanium metal mesh of claim 1, wherein the mesh is expanded from a sheet or coil of solid metal by a factor providing a pattern of voids and a continuous network of strands interconnected by between 500 and 2000 nodes per square meter of the mesh.

6. The titanium metal mesh of claim 1, wherein the mesh strands have thickness within the range of from about 0.05 centimeter to about 0.125 centimeter and width within the range of from about 0.05 centimeter to about 0.20 centimeter.

7. The titanium metal mesh of claim 1, wherein said interconnected metal strands form substantially diamond-shaped apertures having a long way of design within the range of from about 4 to about 9 centimeters and a short way of design within the range of from about 2 to about 4 centimeters.

8. The titanium metal mesh of claim 1, wherein said mesh is in coiled form which can be readily uncoiled.

9. The titanium metal mesh of claim 8, wherein said coil has an inner hollow zone having a diameter greater than about 20 centimeters and an outer diameter of not substantially above about 50 centimeters.

10. The titanium metal mesh of claim 1, wherein said metal mesh is in an uncoiled, at least substantially flat form.

11. The titanium metal mesh of claim 10, wherein said, mesh is a titanium mesh electrode.

12. The titanium metal mesh of claim 11, wherein said electrode connects to a metal current distribution member metallurgically bonded to said mesh.

13. The titanium metal mesh of claim 1, wherein the surface area of the valve metal strands and their connections is not less than 10 percent, nor more than about 50 percent, of the area of the mesh.

* * * * *